United States Patent [19]

Scheiber

[11] Patent Number: 4,964,543

[45] Date of Patent: Oct. 23, 1990

[54] FLUID DISPENSER

[76] Inventor: John G. Scheiber, 4252 N. Range Line Rd., Huntington, Ind. 46750

[21] Appl. No.: 244,151

[22] Filed: Sep. 13, 1988

Related U.S. Application Data

[63] Continuation of Ser. No. 2,456, Jan. 12, 1987, Pat. No. 4,798,312.

[51] Int. Cl.[5] ..... B67D 5/06

[52] U.S. Cl. ..... 222/180; 242/55.53; 248/340

[58] Field of Search ..... 222/173, 180, 105, 181, 222/106; 248/340, 339, 311.2, 318, 215; 242/55.2, 55.53, 55.55

[56] References Cited

U.S. PATENT DOCUMENTS

| | | | |
|---|---|---|---|
| 2,517,988 | 8/1950 | Dobkin | 222/180 |
| 3,179,363 | 4/1965 | Sheiman | 248/340 |
| 3,881,677 | 5/1975 | Ihlenfeld | 248/311.2 |
| 3,891,176 | 6/1975 | Downing et al. | 248/340 |
| 4,106,616 | 8/1978 | Boone | 248/340 |
| 4,354,643 | 10/1982 | Kenner | 242/55.2 |

*Primary Examiner*—H. Grant Skaggs
*Assistant Examiner*—Kenneth Noland

[57] ABSTRACT

A fluid containment chamber has hooked arms whereby it is hung from the paper roll holder spindle in a roll paper dispenser, and has a pump to dispense fluid. The pump is angled upward with operator and pump head dispensing spout at the front. The arms may be folded in a retracted position for compact shipping and storage. The hooked arms may include an elongated rearwardly reaching portion adapted to hang the chamber from either recessed or protruding roll paper dispensers. The hooked arms may include a downwardly sloping lower edge. A sump chamber is provided in the bottom of the fluid containment chamber. Spacer ears may be provided on the upper ends of the arms to wedge the device between the roll paper and the paper dispenser.

28 Claims, 11 Drawing Sheets

FLUID DISPENSER

REFERENCE TO RELATED APPLICATIONS

This application is a continuation-in-part of U.S. patent application Ser. No. 002,456, filed on Jan. 12, 1987, now U.S. Pat. No. 4,798,312 by the same inventive entity, and entitled FLUID DISPENSER.

BACKGROUND OF THE INVENTION

The present invention relates generally to the field of fluid dispensers and more specifically to the field of fluid dispensers integrated with dispensers of roll paper such as toilet paper or paper towels.

The prior art includes various devices attached to or integrated in a toilet paper dispenser. In Boone U.S. Pat. No. 3,848,822 a device is disclosed for dispensing moist sheets or liquid spray from a containment means located within a toilet paper roll tube. U.S. Pat. No. 2,746,798 to Wardell, Jr. and U.S. Pat. No. 2,806,738 to Turro disclose similar intra-tube devices for deodorizing purposes.

Other approaches have means for storing extra rolls of toilet paper from a toilet paper dispenser. One such device is disclosed by Turro U.S. Pat. No. 3,297,265 in which a telescopically mating spindle for holding toilet paper is suspended below the spindle of the toilet paper dispenser. U.S. Pat. No. Des. 259,682 discloses another such device wherein the spare toilet paper roll is held in a trough suspended below the spindle of the toilet paper dispenser.

The present invention is an improvement in that it provides means for the user to conveniently access a supply of fluid from a toilet paper dispenser. In one embodiment of the present invention a device may be suspended from most any design of standard toilet paper dispenser.

The present invention also positions a pump fixture in an orientation more convenient to the user. By orienting the pump axis perpendicular to the axis of rotation of the roll paper, the pump is more readily accessible in some applications than if the pump were located within the spindle. This advantage is enjoyed both when the pump is suspended below the roll of paper and when the pump is located in a cantilevered arm suspending the roll of paper.

The present invention is particularly useful to users needing a supply of cream for treatment of hemorrhoidal inflammation. It is very convenient for persons having to apply hemorrhoidal cream to have it located near a toilet. This invention is particularly well suited to solve this need since toilet paper dispensers are located near toilets.

The present invention is also useful for dispensing other fluids including skin lotions, soaps, aerosol sprays, aerosol foams, and gases. In addition to toilet paper dispensers, the present invention has application to roll dispensers such as paper towel dispensers.

The present invention provides an improved means in which fluids may be packaged in order to more conveniently facilitate their use. For example, hemorrhoidal cream could come packaged in a container embodying the present invention. Such packaging may be disposable or nondisposable or have disposable refills.

SUMMARY OF THE INVENTION

According to one embodiment, the present invention provides a fluid dispensing device suitable for attachment to a paper roll dispenser comprising: fluid container means; suspending means attached to the fluid container means and adapted to suspend the fluid container means from the paper roll dispenser, wherein the suspending means includes a first arm and a second arm, the first arm having a first upper end, the second arm having a second upper end, wherein the first upper end is spaced a distance from the second upper end, the distance greater than the width of the paper roll to be dispensed by the paper roll dispenser to allow the first arm and the second arm to hang on each side of the paper roll, wherein the first upper end and the second upper end each have a rearwardly elongated arm member having a rearward reach greater than one inch and defining a forward spindle stop and a rearward spindle stop thereunder for engaging paper roll dispensers in at least two distinct suspended positions; and fluid dispenser means arranged to pump fluid from the container means.

According to another embodiment, the present invention also provides a fluid dispensing device suitable for attachment to a paper roll dispenser comprising: fluid container means; suspending means attached to the fluid container means and adapted to suspend the fluid container means from the paper roll dispenser, wherein the suspending means includes a first arm and a second arm, the first arm having a first upper end, the second arm having a second upper end, wherein the first upper end is spaced a distance from the second upper end, the distance greater than the width of the paper roll to be dispensed by the paper roll dispenser to allow the first arm and the second arm to hang on each side of the paper roll, wherein the first upper end has a spacer ear attached thereto and adapted to wedge the upper end between the roll of paper being dispensed and the roll dispenser to resist lateral movement of the fluid dispensing device; and fluid dispenser means arranged to pump fluid from the container means.

The present invention also provides a fluid dispensing device suitable for attachment to a paper roll dispenser comprising: fluid container means having a backside, and a bottom wall; suspending means attached to the fluid container means and adapted to suspend the fluid container means from the paper roll dispenser, wherein the suspending means includes a first arm and a second arm, the first arm having a first upper end, the second arm having a second upper end, wherein the first upper end is spaced a distance from the second upper end, the distance greater than the width of the paper roll to be dispensed by the paper roll dispenser to allow the first arm and the second arm to hang on each side of the paper roll, wherein the container means has a hollow sump chamber protruding downwardly below the bottom wall and located near the backside of the container means; and fluid dispenser means arranged to pump fluid from the container means.

The present invention further provides an apparatus for dispensing a fluid and toilet paper to an operator comprising: a building wall structure; a paper roll dispenser having a wall mount, a back side adjacent to the building wall structure, and a front side opposite of the back side, the wall mount mounted to the building wall structure along the back side, the paper roll dispenser further having a pair of cantilevered arms spaced apart a width greater than the width of a standard toilet paper roll, the cantilevered arms each having a recess disposed therein; a toilet paper spindle mounted between the cantilevered arms, the spindle having a pair of ends, a central axis and a pair of outwardly extending posts at opposite ends of the spindle and concentric with the central axis, the posts engagably mounted in the recesses; a fluid container suspended below the spindle by a first arm suspended from the spindle and by a second arm suspended from the spindle, the fluid container having a containment chamber, an opening, and at least one containment wall; a fluid pump mounted in the opening, the fluid pump having a manually reciprocally operable pump head and a pump axis, the pump head reciprocally movable along the pump axis by the operator from the front side, the pump axis projecting in an outward direction from the building wall structure allowing the operator's movement of the pump head to be forceably resisted by the building wall structure.

One object of the present invention is to provide a liquid dispenser.

Related objects and advantages of the present invention will be apparent from the following description.

DESCRIPTION OF THE PREFERRED EMBODIMENT

Figure 1:
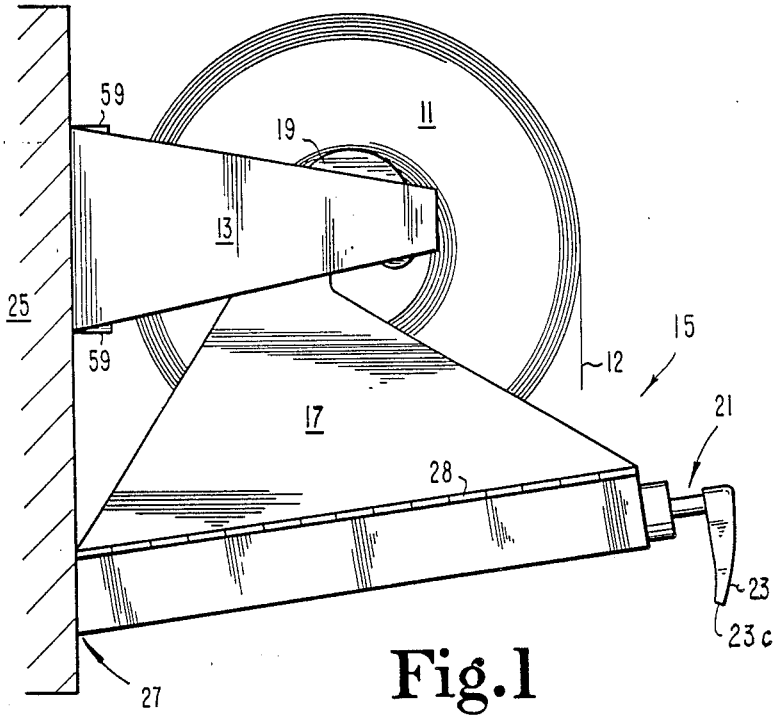
FIG. 1 is a side view of one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIGS. 1, 2, 3 and 4, toilet paper roll 11, typically about 4½ inches wide, is suspended between a pair of cantilevered arms 13 and 14, and preferably with the paper end 12 out, away from wall 25, as shown in FIGS. 1, 2, 3 and 4. Fluid dispensing device 15 is suspended from wall-mounted, cantilevered arms 13 and 14 by hanger arms 17 and 18 which include hook-like upper ends 19 and 20. Fluid dispensing device 15 includes fluid pump 21 having a pump head 23. Pump 21 is a standard off-the-shelf manually reciprocally operated pump for dispensing fluids. Such pumps are frequently found in containers for dispensing hand lotion, soaps and the like. Arms 13 and 14 are mounted to wall mount 59 which is mounted to building wall structure 25. Wall mount 59 is similar to wall mount 359 shown in FIGS. 7, 8 and 9, except that wall mount 59 is positioned between arms 13 and 14 whereas wall mount 359 is positioned behind arms 313 and 314. It will be recognized that the present invention can be employed with a great variety of wall mountings.

A conventional toilet paper spindle 35 such as is commonly available, and having tapered end post portions 33, is supported between and by the arms 13 and 14. Spindle 35 typically is telescopically collapsible along its axis 36 (FIG. 4) to facilitate mounting between the arms. The upper ends 19 and 20 of hanger arms 17 and 18, respectively, are hooks suitably sized to hook over posts 33. The upper ends 19 and 20 of arms 17 and 18 may, in an alternative embodiment (not shown), be in the form of a complete loop, rather than a hook, around posts 33.

Figure 2:
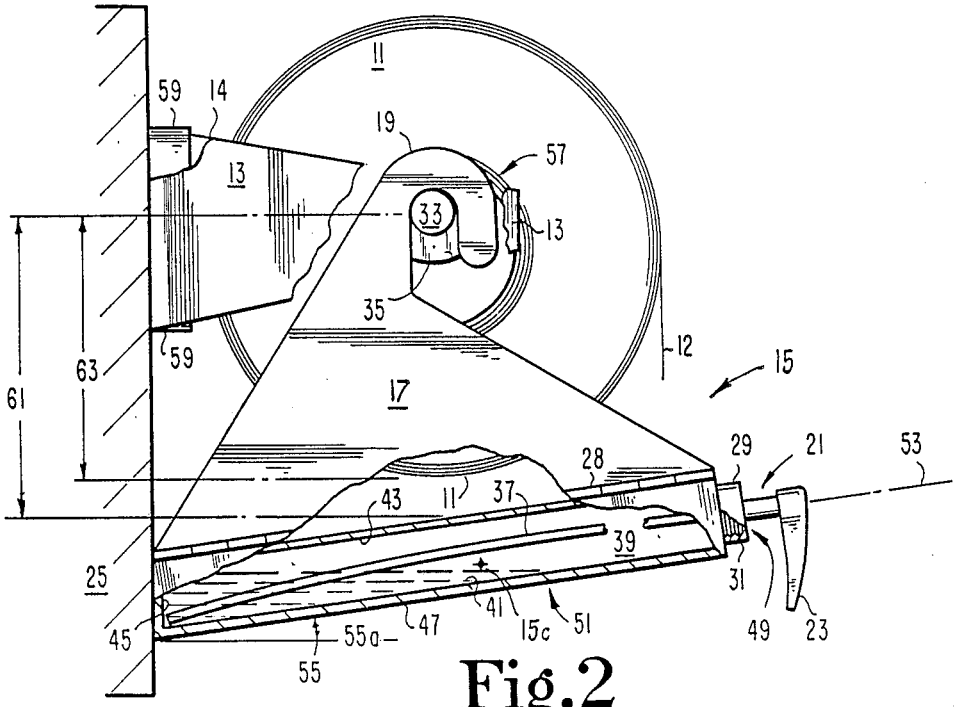
FIG. 2 is a partial cutaway side view of the device of FIG. 1.
Figure 3:
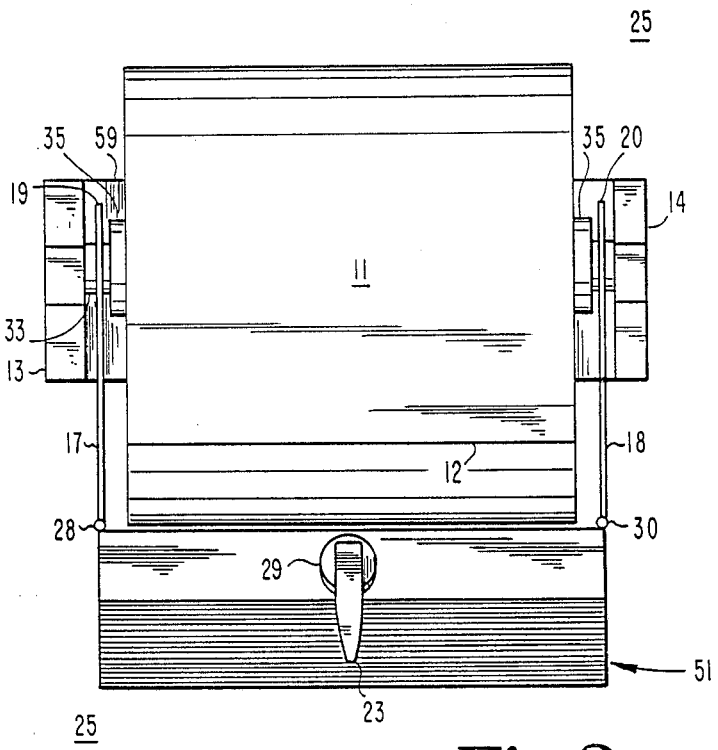
FIG. 3 is a front view of the device of FIG. 1.

In FIG. 2. first arm 13 and fluid dispensing device 15 are partially cut away to show fluid container and pump details. A fluid container 51 includes a containment chamber 39 defined by a plurality of containment walls such as upper containment wall 43, rear containment wall 45, bottom containment wall 47, side containment walls and a front containment wall. Chamber 39 has one opening 49 which is in the front containment wall and surrounded by the threaded neck or lip 31 which is covered by cap 29 and fluid pump 21. Cap 29 is internally threaded, surrounding pump 21 and is threaded onto externally threaded lip 31.

Fluid pump 21 includes pump tube 37 inside of containment chamber 39. Fluid 41 is kept in containment chamber 39 and dispensed out of fluid pump 21 by way of pump tube 37 and dispensed from outlet 23*e* when the pump head 23 is pushed toward the wall 25.

Fluid dispensing device 15, although preferably made of plastic, is preferably proportioned or weighted so its center of gravity 15*c* (FIG. 2) is farther from wall 25 than is a line through the posts 33, so the device normally abuts wall 25 at back side 27. The pump user typically will be on the front side of the paper roll dispenser, while the building wall structure 25 is behind the dispenser. The abutting at back side 27 acts to forceably resist the pumping motion the operator causes when he pushes the pump head 23 on the plunger of pump 21. Note that similar forceable resistance is provided in the other embodiment illustrated in FIGS. 6, 7, 8 and 9. The removable cap 29 on opening 49 allows refilling of containment chamber 39 with fluid 41.

Figure 4:
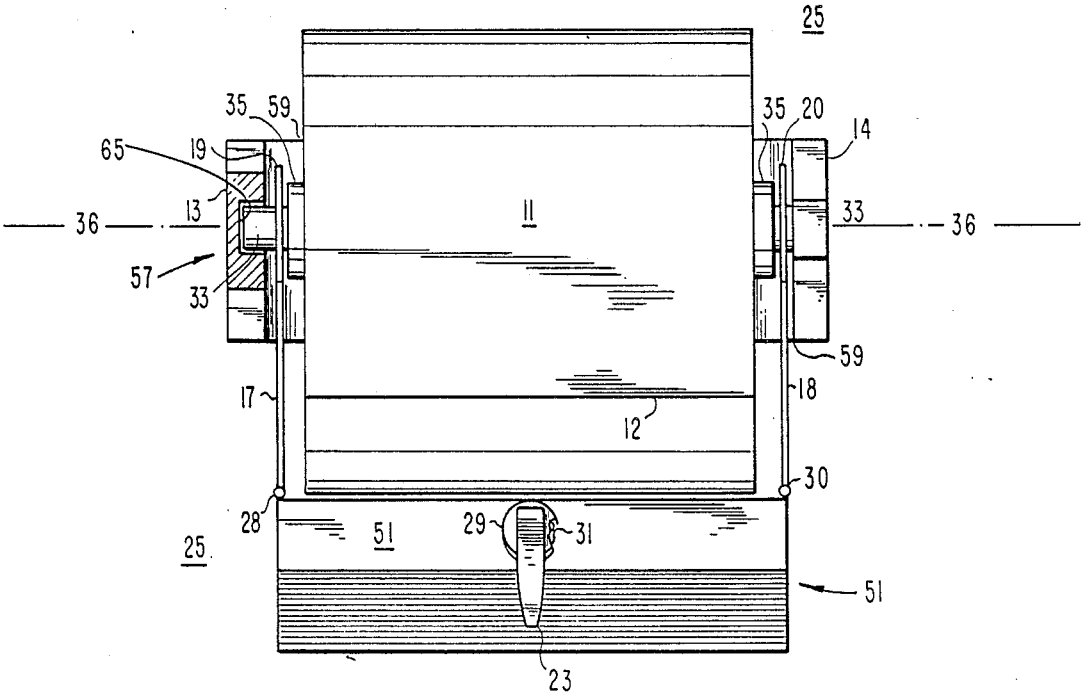
FIG. 4 is a partial cutaway front view of the device of FIG. 3.

Pump head 23 of fluid pump 21 is manually reciprocally operated along pump axis 53. This axis is oriented at a convenient upward angle 55 relative to horizontal 55*a*. For reliable positive action against the backing, to achieve the above mentioned forceable resistance, it is desirable that the pump axis 53 lie in a plane perpendicular to the wall 25, and that pump axis 53 is perpendicular to a plane containing the axis of rotation (not shown) of paper roll 11 and is directed outwardly from building wall structure 25. The axis of rotation of paper roll 11 is that axis which is concentric with the cylindrical shape of paper roll 11 and parallel to central axis 36 as shown in FIG. 4.

As evident from the above description, fluid container 51 is suspended by arms 17 and 18 below paper roll dispenser 57. Container 51 is suspended below the roll dispenser 57 a distance determined by arm length 61 of arms 17 and 18. Arm length 61 is greater than radius 63 from spindle axis 36 (FIG. 4) to the bottom of paper roll 11. In this way, the roll will not rub against upper containment wall 43 during dispensing of paper from the roll. FIG. 4 includes a partial cutaway front view of arm 13 of FIG. 3 which has recess or socket 65 in it, as does arm 14. Posts 33 are located in recesses 65. Cap 29 is partially cut away to show containment chamber lip 31. Connecting means are provided at 28 and 30 and allow arms 17 and 18 to be disconnected from or folded downwardly onto fluid container 51 as shown for arm 17, for example, in FIG. 5. This facilitates initial packaging, storage and shipment. The materials are preferably plastic. The connecting means 28, 30 are shown as "piano hinges" to emphasize the location. However, for separate arms, they can include a groove molded into the lower edge of the arm, and an upstanding rib or rail molded along the upper corner of the container at each side, with the arm longitudinally slided onto the rib, in a dovetail or other suitably interconnecting relationship of the rib and groove. Another approach would make the arms and container integral, but use the well known "living hinge" technique at 28 and 30 so arms 17 and 18 may be folded down onto the flat, top portion of fluid container 51 for packing and shipping.

Figure 5:
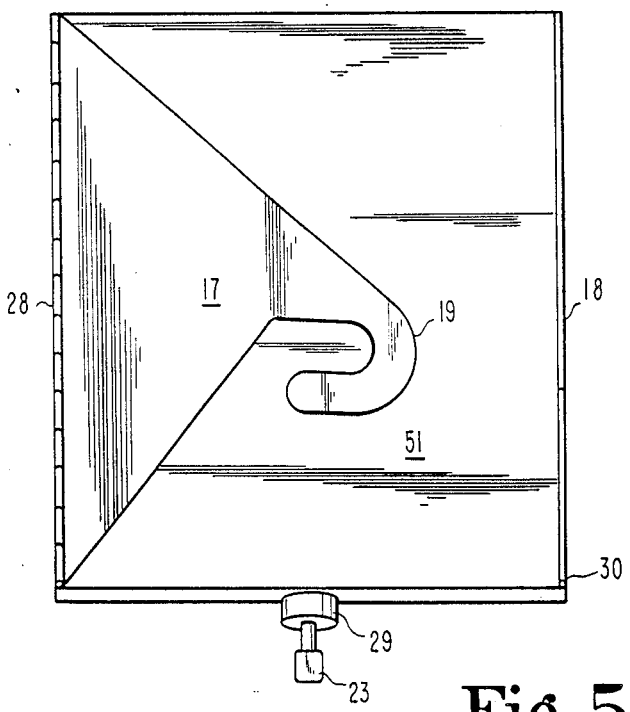
FIG. 5 is a top view of the device of FIG. 1 with one of the hanger arms folded flat.

FIG. 5 illustrates a top view of the fluid container 51 together with fluid pump 21, first arm 17 folded down and second arm 18 raised, to show how the arms fold for shipping. In FIG. 5, building wall structure 25, paper roll dispenser 57, and paper roll 11 are not shown.

Figure 6:
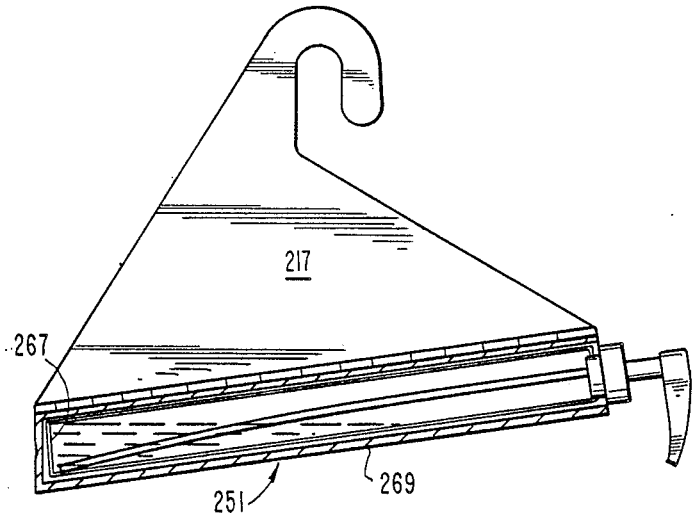
FIG. 6 is a partial side cutaway view of an alternative embodiment of the present invention.

FIG. 6 shows an alternative embodiment of the present invention. It differs from that of FIGS. 1–5 in that it has an inner refill shell 267 located within outer shell 269. Collectively, inner refill shell 267 and outer shell 269 make up fluid container 251. Inner refill shell 267 is slidably disposed in outer shell 269. Thus, when inner refill shell 267 is empty or needs replacement, it may be removed and replaced without having to replace outer shell 269 with its attached hanger arms such as 217.

Figure 7:
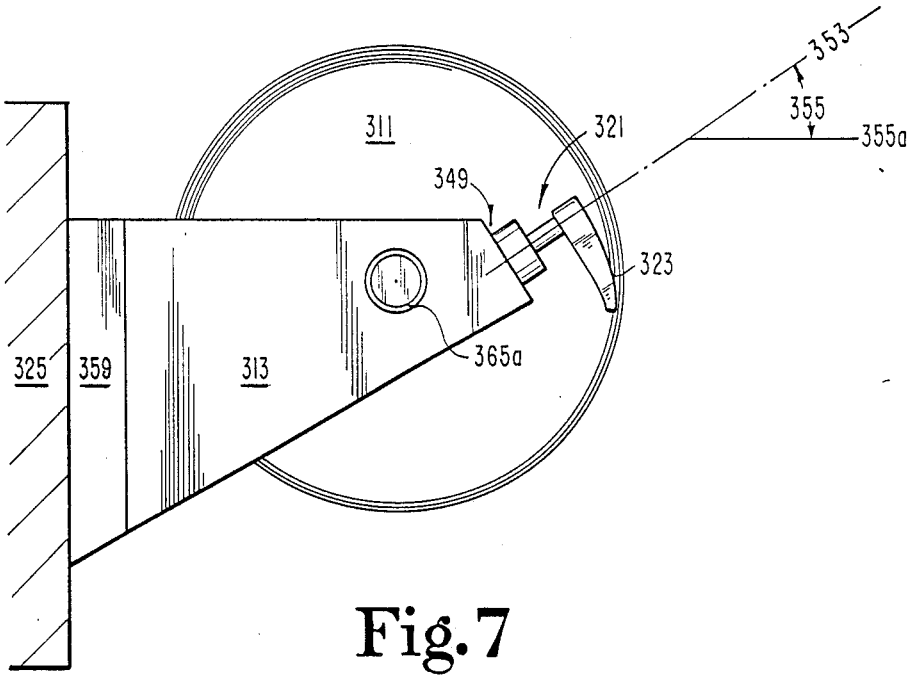
FIG. 7 is a side view of another alternative embodiment of the present invention.
Figure 8:
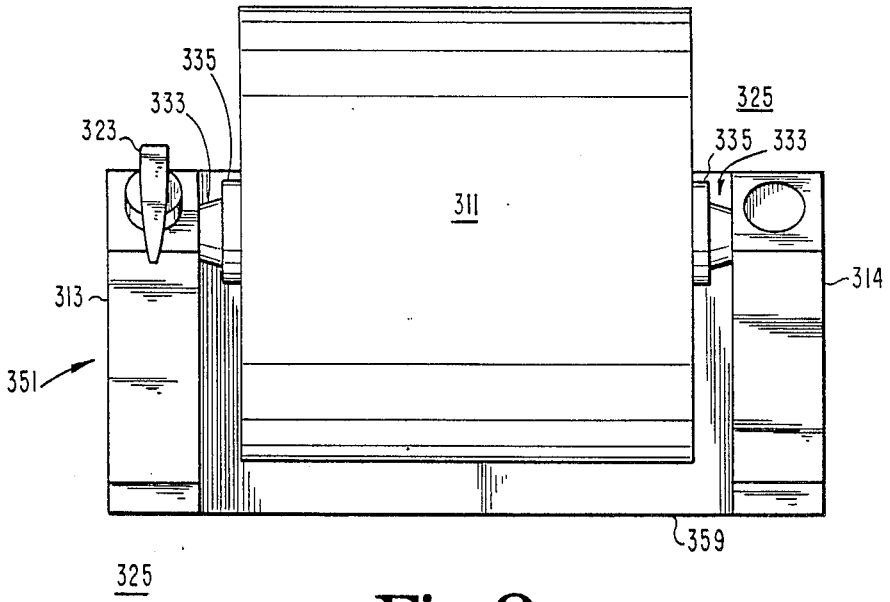
FIG. 8 is a front view of the device of FIG. 7.
Figure 9:
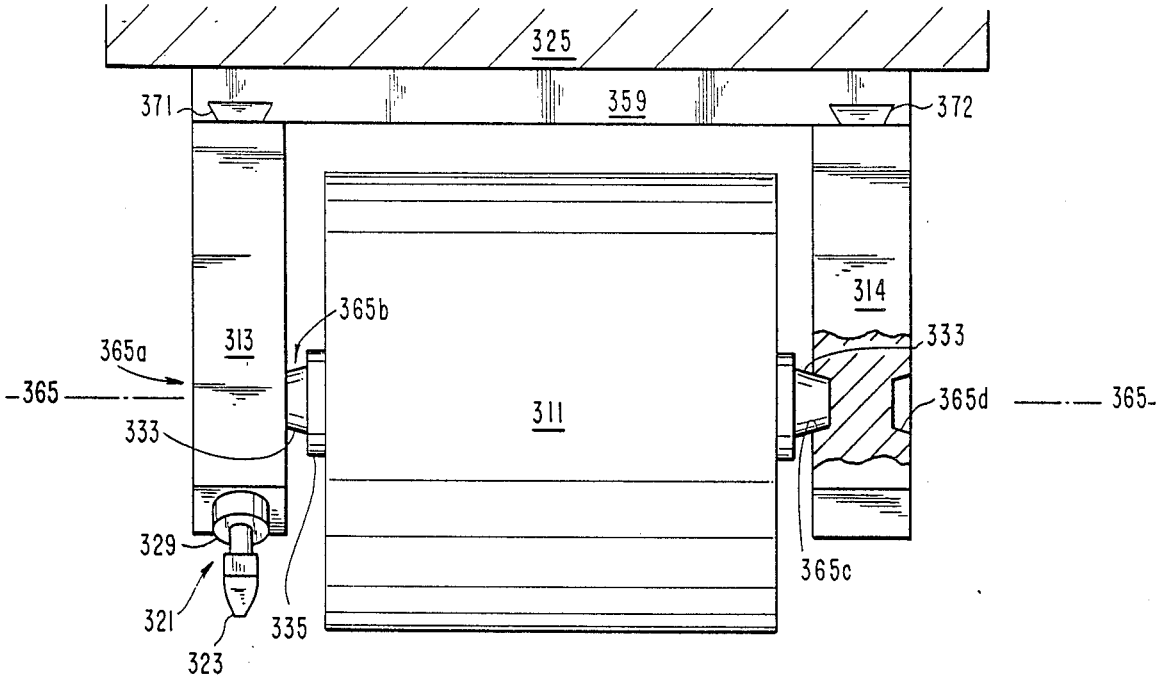
FIG. 9 is a partial cutaway top view of the device of FIG. 8.
Figure 10:
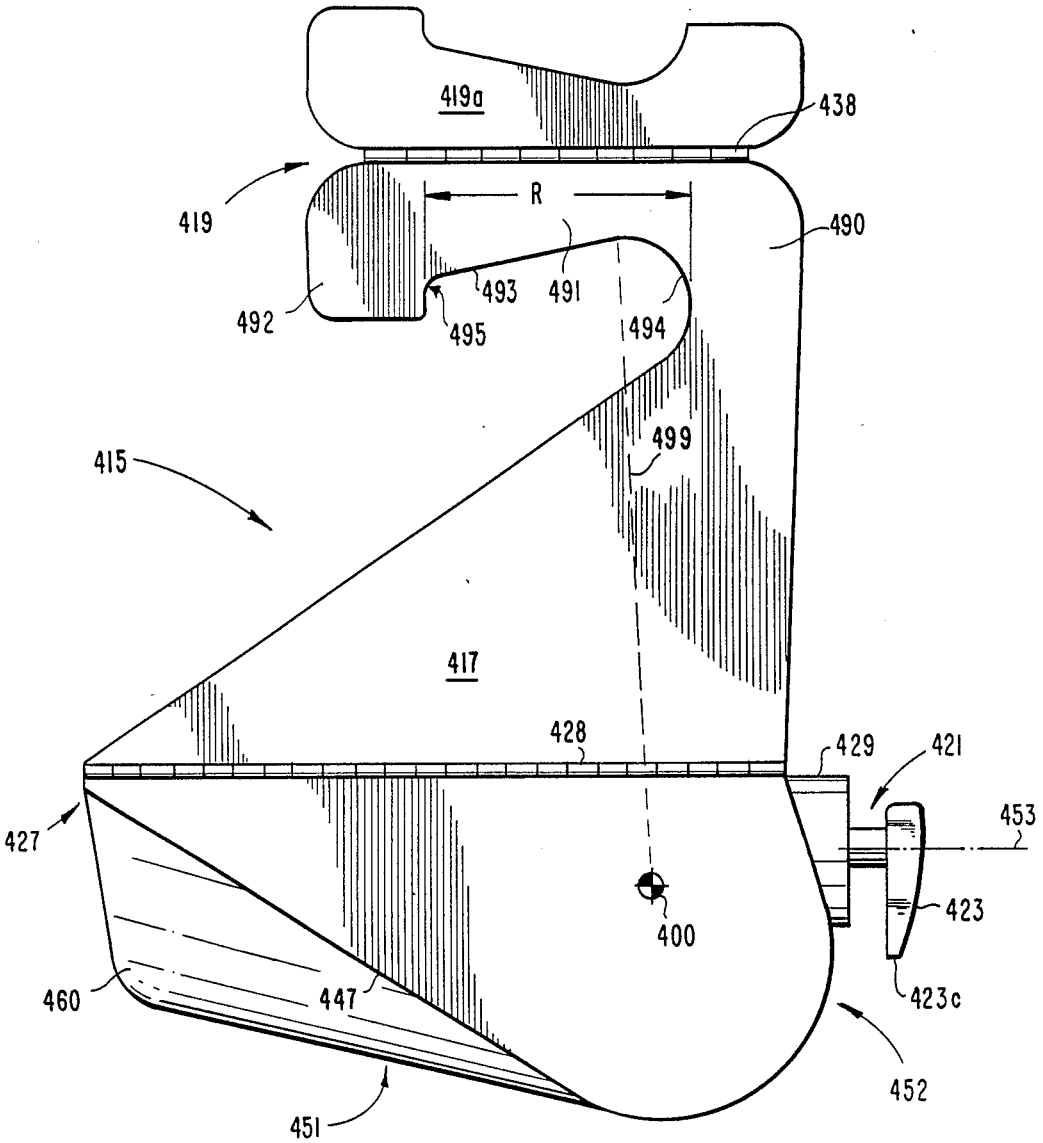
FIG. 10 is a side view of another alternative embodiment of the present invention.

FIGS. 7, 8 and 9 illustrate a second alternative embodiment of the present invention. First and second cantilevered arms 313 and 314 are attached to wall mount 359 which in turn is fastened to building wall structure 325. Paper roll 311 is suspended and supported on spindle assembly 333, 335 between arms 313 and 314. Fluid pump 321 is mounted in opening 349. Opening 349 is substantially similar to opening 49 in FIG. 2. Likewise, pump 321 has pump head 323 which is substantially similar to pump head 23 in FIG. 2. Pump axis 353 is oriented in an upward angle 355 relative to horizontal **355*a*. Pump head 323 is manually reciprocally operable along pump axis 353 and, like pump 21 in FIG. 2**, is a standard item.

FIG. 8 illustrates a front view of the device illustrated in FIG. 7. Fluid container 351 is disposed in arm 313. In the illustrated embodiment, fluid container 351 is the same and defined by arm 313 which is hollow. Arm 314 is of similar geometry to arm 313, but does not have fluid pump 321 mounted in it. Arm 314 is a dummy version of arm 313. However, this embodiment of the present invention would be practiced also if second cantilevered arm 314 had a pump and fluid container disposed in it substantially similar to arm 313. Spindle 335 supports paper roll 311 by having its posts 333 bearing in recesses such as **365*c* (FIG. 9) which is like 365*a* in FIG. 7. Spindle 335 typically is telescopically collapsible along axis 365 to facilitate mounting between arms 313 and 314** just as in the first embodiment.

Recess **365*a* (FIG. 7) is located on the outside of arm 313. There is a corresponding recess (not shown) on the inside of arm 313. This allows interchangeability of arms on either side of the wall mount 359** when arms are replaced.

FIG. 9 illustrates a top view of the device illustrated in FIGS. 7 and 8. FIG. 9 has a partial cutaway portion to illustrate recesses **365*c* and 365*d* supporting post 333. Central axis 336 is concentric with spindle 335. Recesses 365*c* and 365*d* are located in both sides of arm 314. Similar recesses exist in arm 313. Fluid pump 321 has a cap 329 which is substantially similar to cap 29 in FIG. 2. Cap 329 in the preferred embodiment is a threaded cap, threading around a threaded lip (not shown in FIG. 9). Wall mount 359 is mounted to building wall structure 325. Arm 313 is mounted to wall mount 359 by way of channel lock or key 371. Similarly, arm 314 is mounted to wall mount 359 by channel lock 372. In this way, each cantilevered arms may be removed by sliding it vertically away from wall mount 359. In this way, cantilevered arms such as arm 313 may be removed and replaced. When, for example, first cantilevered arm 313 is used as a fluid container 351**, it may be readily removed and replaced when it is empty.

Figure 11:
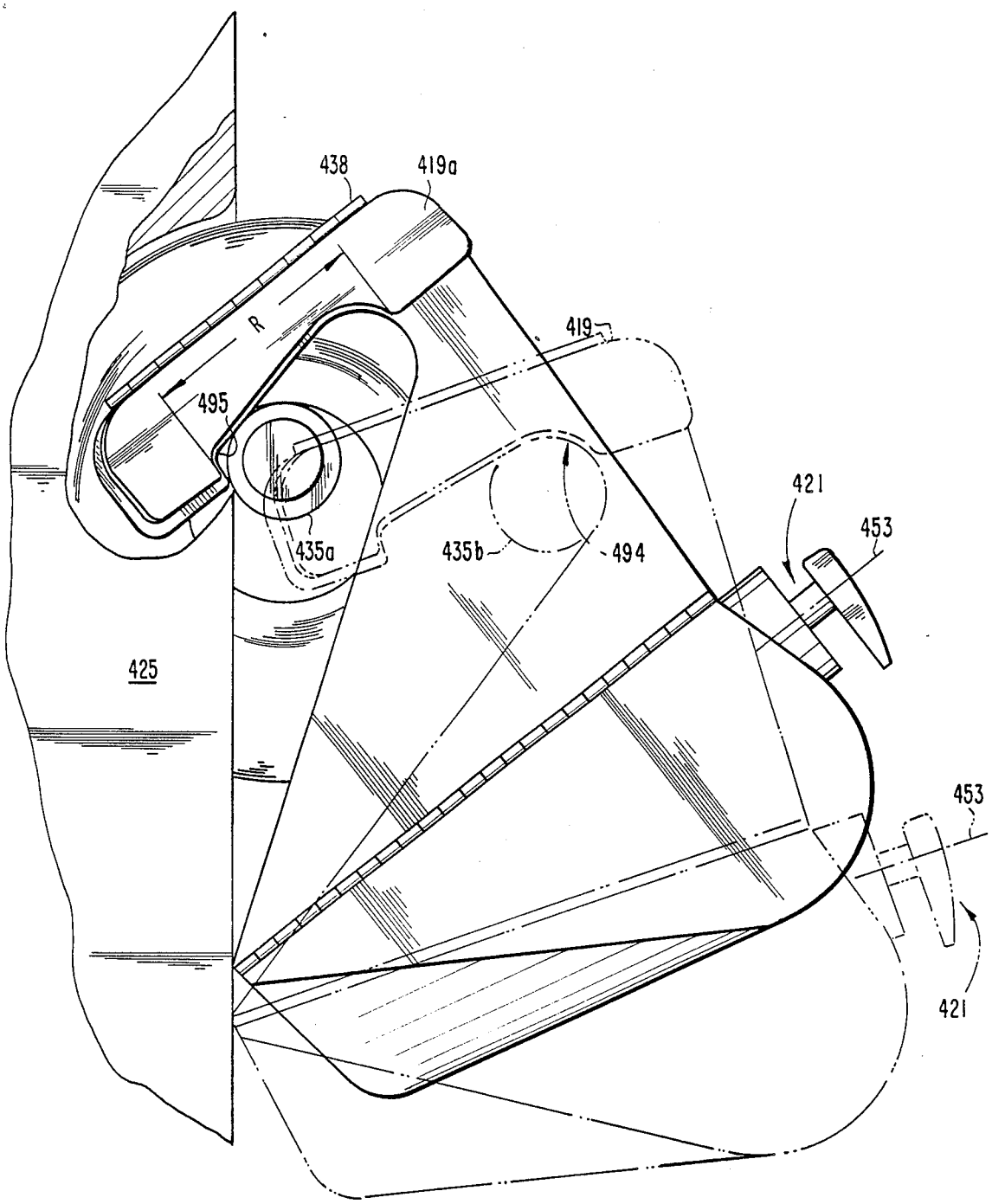
FIG. 11 is a side view of the device of FIG. 10 with an alternate orientation thereof superimposed in phantom lines.
Figure 12:
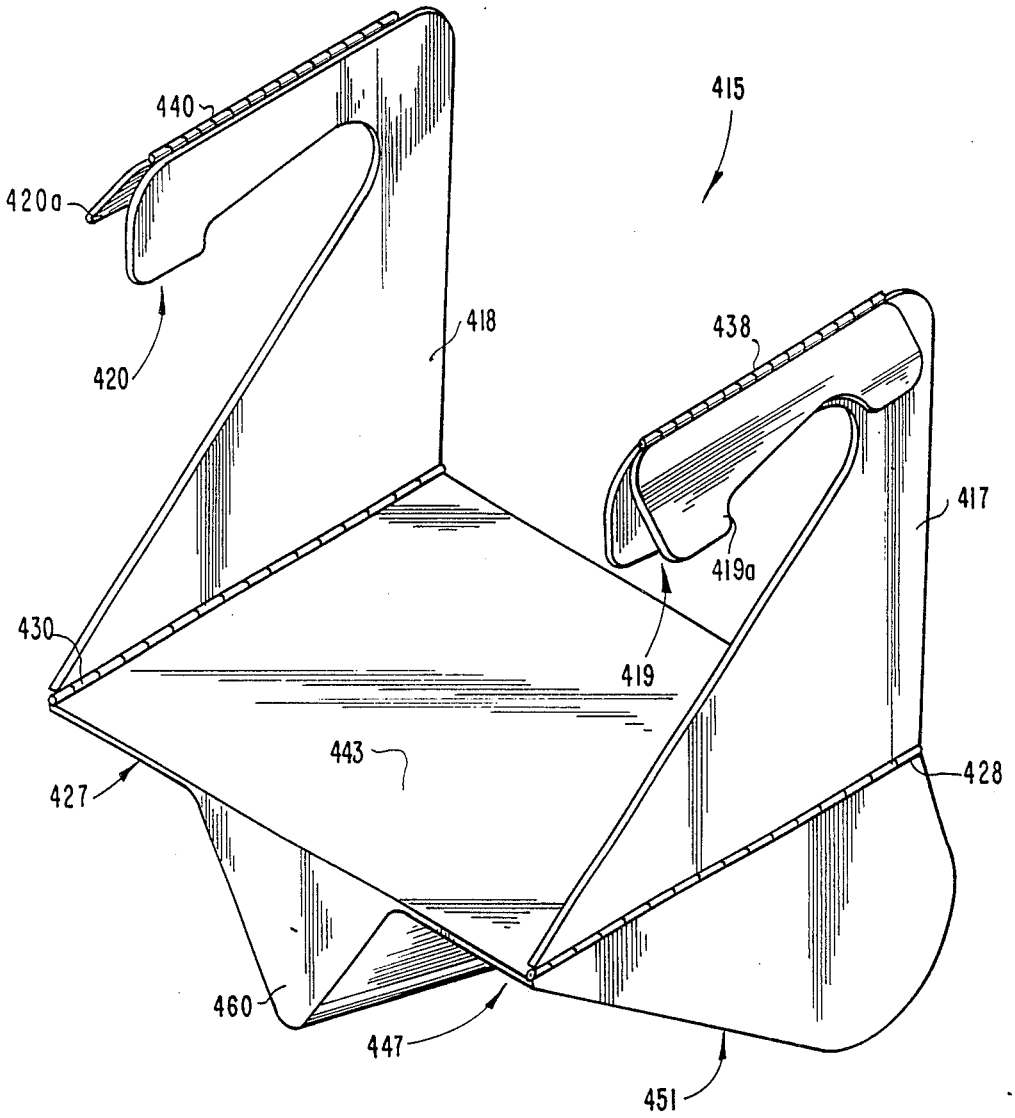
FIG. 12 is a rear perspective view of the device of FIG. 10.

Referring now to FIGS. 10–15, a fourth embodiment of the present invention is shown. Fluid dispensing device 415 has fluid container 451 suspended by and below arm 417 and arm 418. Arm 417 has an upper end 419, and similarly arm 418 has upper end 420. In this embodiment, the upper ends form hooks having a rearward reach as opposed to the forward reach of hooks illustrated in FIGS. 1 and 2. Upper end 419 includes an upward segment 490 (see FIG. 10) integral with arm 417, and further includes a rearwardly elongated arm member 491 projecting to the rear from the upper portion of upward segment 490. Rearwardly elongated arm member 491 has an elongated reach R which is preferably greater than one inch, and in the preferred embodiment is $1\frac{3}{4}$ inches long. Connected to arm member 491 at the end of reach R is downward hook segment 492. With upper end 419 and arm member 491 defining reach R, the present invention is adapted to be suspended from a variety of roll paper dispensers. More specifically, some roll paper dispensers fully project away from the wall so that the paper roll is beyond the surface of the wall (see FIG. 1), whereas other roll paper dispensers are at least partially recessed into the wall so that the paper roll is at least partially recessed behind the surface of the wall (see FIG. 11). Upper end 419 with its reach R provides a singular design which is adaptable for both types of roll paper dispensers. A forward spindle stop 494 is defined beneath arm member 491 under lower edge 493. Furthermore, rearward spindle stop 495 is provided to the rear of stop 494, and likewise is positioned below lower edge 493. As shown in FIG. 11, rear spindle stop 495 receives spindle **435*a* in a recessed type roll paper dispenser. FIG. 11 further shows in phantom lines the present invention's suspended position when spindle 435*b* is located on a non-recessed roll paper dispenser of the type illustrated in FIG. 1. In the non-recessed version, spindle 435*b* is received in forward spindle stop 494. Thus, rearward reach arm allows fluid container 451 to be suspended below the spindle and the paper roll for both recessed and non-recessed dispensers. Note that by comparing the two modes illustrated in FIG. 11, pump axis 453 of fluid pump 421 is at a different angular position with respect to wall 425. Thus, the present invention provides a fluid dispensing device with a forward spindle stop and a rearward spindle stop for engaging paper roll dispensers in at least two distinct suspended positions, depending on the location of the spindle with respect to the wall. Of course, the present invention is adapted to work for a variety of spindle positions intermediate of or different from those shown in FIG. 11. For example, it will be evident that if the arm member 491 is made longer so that it has a greater reach "R", the attitude of the axis 453 can be decreased and the axis made more horizontal for esthetic purposes if desired, even where the spindle is close to the wall surface as in FIG. 11, or recessed. The same effect can be achieved if the backside 427 does not extend so far back with respect to the rearward spindle stop. Also, if the apparatus is shortened so that the backside is closer to the forward spindle stop, the attitude of the axis 453 will be more horizontal than shown in the dashed line in FIG. 11 when the spindle is well outward from the wall as at 435***b*.

To facilitate the nesting of the spindle in forward spindle stop 494, lower edge 493 of rearwardly elongated arm member 491 has a downward slope with respect to pump axis 453 taken from forward spindle stop 494 to rearward spindle stop 495. Furthermore, the slope of lower edge 493 is downward with respect to a line 499 (see FIG. 10) taken between the center of gravity 400 and the apex of forward spindle stop 494. Accordingly, this downward slope of lower edge 493 urges the forward spindle stop 494 towards the spindle when device 415 is suspended from a spindle such as 435*b*. This downward slope, when taken with respect to axis 453, is preferably at about a 1:6 ratio. In all cases, however, it is important that the combination of the slope of the support edge 493, locations of spindle stops 494 and 495, and backside 427 and center of gravity be such that the unit be stable and the backside 427 bearing on wall 425.

Figure 14:
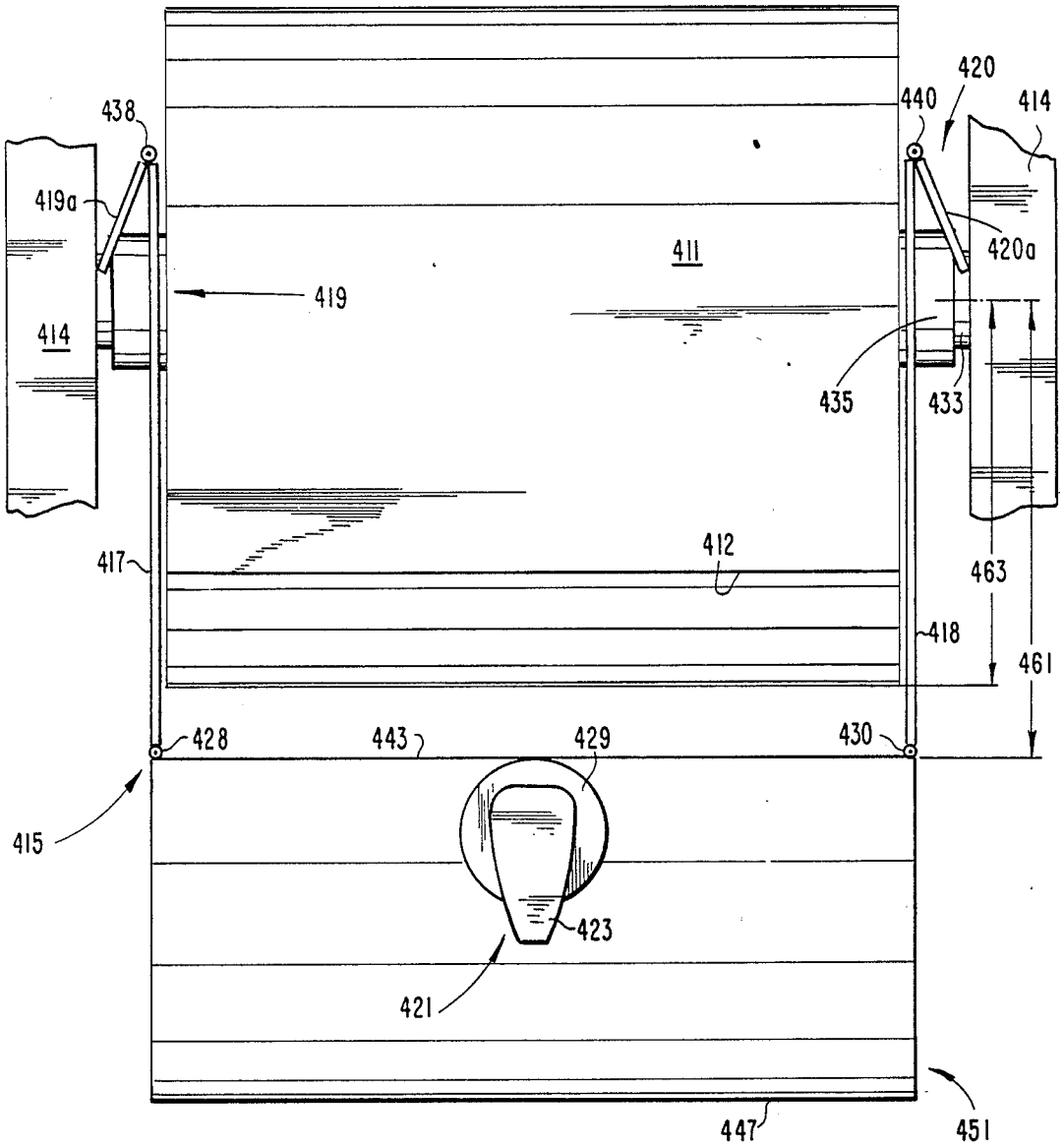
FIG. 14 is a front view of the device of FIG. 10.
Figure 15:
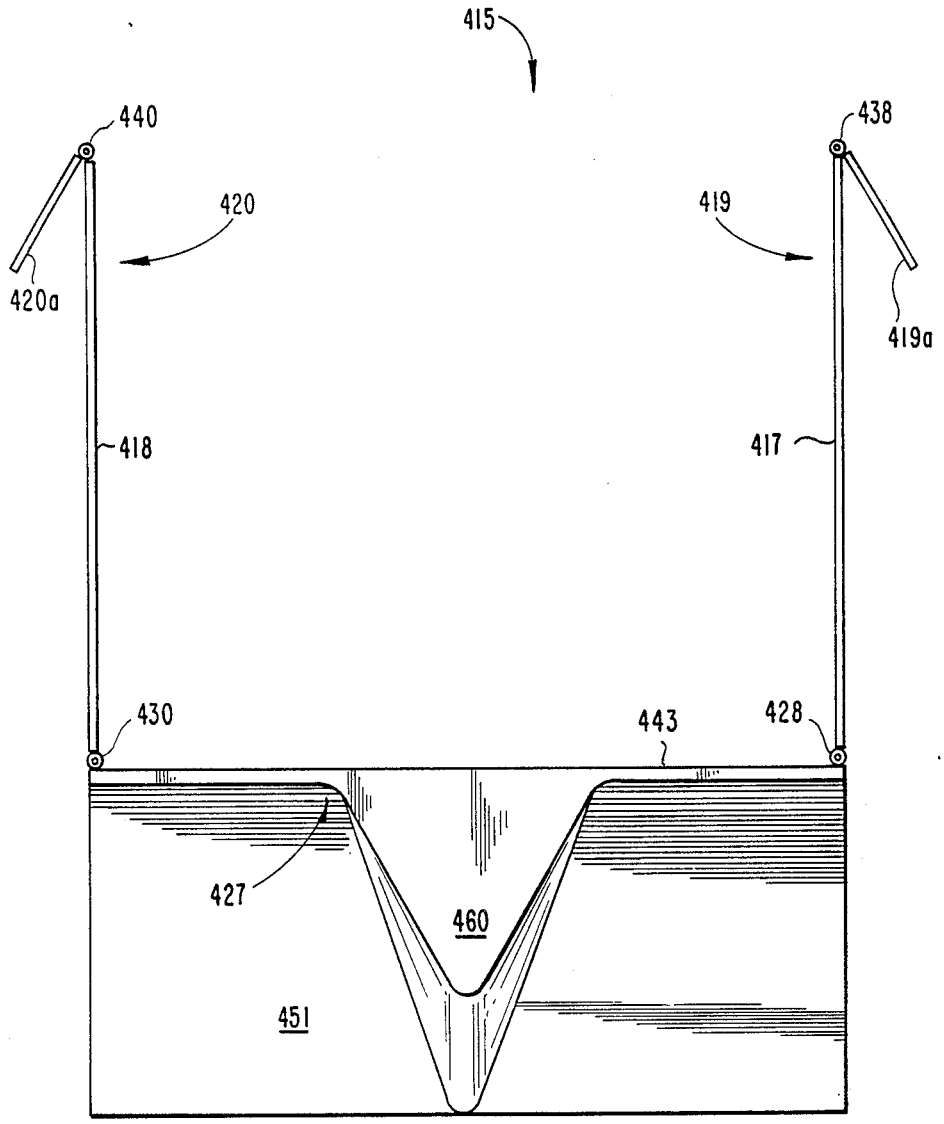
FIG. 15 is a rear view of the device of FIG. 10.

Referring further to FIGS. 10, 12, 14 and 15, upper end 419 and upper end 420 each have a spacer ear 419*a* and 420*a*, respectively, attached thereto. Ear 419*a* is attached to upper end 419 by way of hinge 438. Likewise, spacer ear 420*a* is attached to upper end 420 by hinge 440. These hinges may be of a variety of designs, including a living hinge. The profile of these spacer ears preferably is a mirror image of their corresponding upper end so they may be folded down thereupon and have the same general shape. As illustrated in FIG. 14, the function of these spacer ears is to wedge upper end 420 between the roll of paper 411 being dispensed and the roll dispenser 414 to resist lateral movement of fluid dispensing device with respect to the paper roll dispenser. Spacer ear 419*a* provides a similar function with upper end 419. Hinges 440 and 438 allow for their corresponding spacer ears to adapt to various gap widths between the roll of paper and the paper roll dispenser which may occur with various paper roll dispenser designs.

Fluid container 451 is a hollow chamber in which a fluid such as a lotion or other medicament may be contained. Container 451 has a front end 452 and has various containment walls including bottom containment wall 447 and upper containment wall 443. Fluid is dispensed through fluid pump 421 having pump head 423 and cap 429. Preferably, pump 421 is one wherein the pump head reciprocates along pump axis 453 to dispense fluid from outlet 423*c* when head 423 is pushed.

Fluid container 451 is suspended below spindle 435 by arms 417 and 418 each an arm length 461 which is greater than radius 463 of paper roll 411. In this way, fluid container 451 does not impede with the rotational movement caused by removal from paper end 412 of paper roll 411. Note that optionally, arms 417 and 418 may be attached to fluid container 451 by hinge 428 and hinge 430, respectively, to allow for compact collapsing of the arms onto the fluid container as previously described (see FIG. 5).

Referring further to FIGS. 10, 12, 13 and 15, fluid container 451 has a fluid sump 460 which protrudes downwardly below bottom containment wall 447 and is located along the rear of container 451. Sump 460 forms a hollow chamber contiguous with the hollow chamber of container 451 into which fluid flows. The end of the pump tube (such as pump tube 37 shown in FIG. 2) for pump 421 preferably rests in sump 460 to allow complete withdrawal of fluid from the fluid container.

In the preferred embodiment, sump 460 is formed by a three sided pyramid projecting below bottom containment wall 447 and located along the center of backside 427. Note that backside 427 abuts against wall 425.

Figure 16:
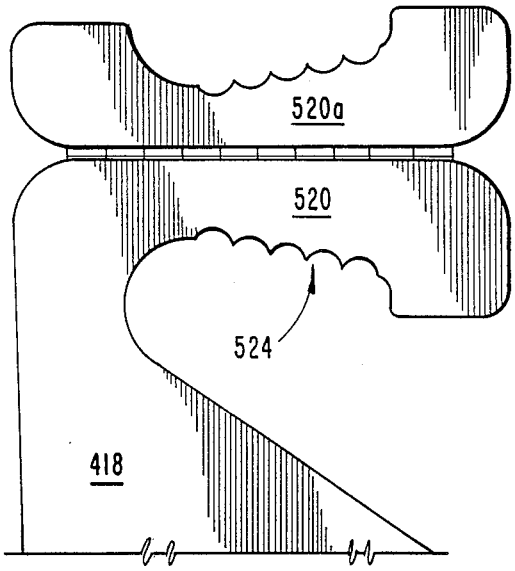
FIG. 16 is a partial side view of another alternative embodiment of the present invention.
Figure 13:
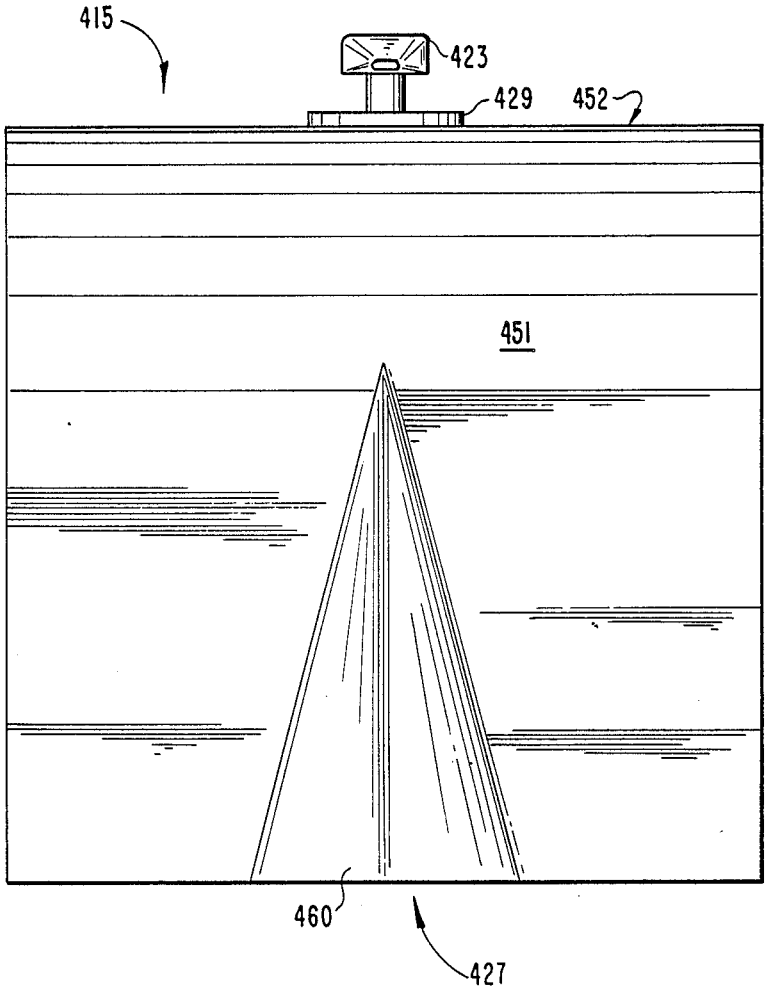
FIG. 13 is a bottom view of the device of FIG. 10.

Referring now to FIG. 16, a portion of a fifth embodiment of the present invention is shown. FIG. 16 illustrates upper end 520 which is the upper portion of arm 418, and is similar to upper end 420 illustrated in and described in conjunction with FIGS. 10–15. However, upper arm 520, and its corresponding spacer ear 520*a*, each have serrations, such as serrations 524. The serrations provide shear and frictional resistance against the top side of the spindle from which the arm is suspended. The serrations are preferably provided on both arms of this embodiment. Alternatively, friction may be provided by the use of rubber or other material having a high coefficient of friction placed along the lower edge of upper end 520. Note also that serrations 524 are provided on a downward slope as discussed previously with lower edge 493.

Although the embodiments discussed herein deal with toilet paper, the present invention may just as well work with other forms of paper dispensers including paper towel dispensers. Fluids to be dispensed may include hemorrhoidal cream, soaps, aerosol foams, aerosol sprays, hand lotions, and other liquids. Fluid containers may be either disposable or nondisposable.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fluid dispensing device suitable for attachment to a paper roll dispenser comprising:

fluid container means;

suspending means attached to said fluid container means to suspend said fluid container means from the paper roll dispenser, wherein said suspending means includes a first arm and a second arm, said first arm having a first upper end, said second arm having a second upper end, wherein said first upper end is spaced a distance from said second upper end, said distance being greater than the width of the paper roll to be dispensed by the paper roll dispenser to allow said first arm and said second arm to hang on each side of the paper roll, wherein said first upper end and said second upper end each have a rearwardly elongated arm member having a rearward reach greater than one inch and defining a forward spindle stop and a rearward spindle stop thereunder for engaging paper roll dispensers in at least two distinct suspended positions corresponding to distinct locations of a paper roll spindle with respect to a wall supporting the paper roll dispenser; and fluid dispenser means arranged to pump fluid from said container means.

2. The device of claim 1 wherein said first arm has a first arm length and said second arm has a second arm length, and wherein said first arm length and said second arm length are each greater than the radius of an unused paper roll to be dispensed by the paper roll dispenser.

3. The device of claim 1 wherein said first upper end and said second upper end each include rearwardly facing hooks and wherein said reach of said hooks is about one and three-quarters of an inch.

4. A fluid dispensing device suitable for attachment to a paper roll dispenser comprising:

fluid container means;

suspending means attached to said fluid container means to suspend said fluid container means from the paper roll dispenser, wherein said suspending means includes a first arm and a second arm, said first arm having a first upper end, said second arm having a second upper end, wherein said first upper end is spaced a distance from said second upper end, said distance being greater than the width of the paper roll to be dispensed by the paper roll dispenser to allow said first arm and said second arm to hang on each side of the paper roll, wherein said first upper end and said second upper end each have a rearwardly elongated arm member having a rearward reach greater than one inch and defining a forward spindle stop and a rearward spindle stop thereunder for engaging paper roll dispensers in at least two distinct suspended positions;

fluid dispenser means arranged to pump fluid from said container means; and wherein said fluid dispenser means defines an axis, and wherein said rearwardly reaching arms of said first upper end and of said second upper end each include an elongated lower edge having a downward slope taken from said forward spindle stop to said rearward spindle stop with respect to said axis.

5. The device of claim 4 wherein said first upper end has a spacer ear attached thereto and adapted to wedge said upper end between the roll of paper being dispensed and the roll dispenser to resist lateral movement of the fluid dispensing device.

6. The device of claim 5 wherein said container means has a bottom wall and further has a hollow sump chamber protruding downwardly below said bottom wall and located near the backside of said container means.

7. The device of claim 6 wherein said first arm has a first arm length and said second arm has a second arm length, and wherein said first arm length and said second arm length are each greater than the radius of an unused paper roll to be dispensed by the paper roll dispenser.

8. The device of claim 7 wherein said first upper end and said second upper end each include rearwardly facing hooks and wherein said reach of said hooks is about one and three-quarters of an inch.

9. The device of claim 8 wherein said first arm and said second arm are hingedly secured to said fluid container outer shell and are collapsible thereon for storage.

10. The device of claim 9 wherein said lower edges of said rearwardly reaching arms are serrated to provide resistance against movement of said lower edges with respect to the mandril of the paper roll dispenser.

11. The device of claim 4 wherein said lower edges of said rearwardly reaching arms are serrated to provide resistance against movement of said lower edges with respect to the mandril of the paper roll dispenser.

12. A fluid dispensing device suitable for attachment to a paper roll dispenser comprising:

fluid container means;

suspending means attached to said fluid container means to suspend said fluid container means from the paper roll dispenser, wherein said suspending means includes a first arm and a second arm, said first arm having a first upper end, said second arm having a second upper end, wherein said first upper end is spaced a distance from said second upper end, said distance being greater than the width of the paper roll to be dispensed by the paper roll dispenser to allow said first arm and said second arm to hang on each side of the paper roll, wherein said first upper end and said second upper end each have a rearwardly elongated arm member having a rearward reach greater than one inch and defining a forward spindle stop and a rearward spindle stop thereunder for engaging paper roll dispensers in at least two distinct suspended positions;

fluid dispenser means arranged to pump fluid from said container means; and wherein said first upper end has a spacer ear attached thereto and adapted to wedge said upper end between the roll of paper being dispensed and the roll dispenser to resist lateral movement of the fluid dispensing device.

13. The device of claim 12 wherein said container means has a bottom wall and further has a hollow sump chamber protruding downwardly below said bottom wall and located near the backside of said container means.

14. A fluid dispensing device suitable for attachment to a paper roll dispenser comprising:

fluid container means;

suspending means attached to said fluid container means to suspend said fluid container means from the paper roll dispenser, wherein said suspending means includes a first arm and a second arm, said first arm having a first upper end, said second arm having a second upper end, wherein said first upper end is spaced a distance from said second upper end, said distance being greater than the width of the paper roll to be dispensed by the paper roll dispenser to allow said first arm and said second arm to hang on each side of the paper roll, wherein said first upper end and said second upper end each have a rearwardly elongated arm member having a rearward reach greater than one inch and defining a forward spindle stop and a rearward spindle stop thereunder for engaging paper roll dispensers in at least two distinct suspended positions;

fluid dispenser means arranged to pump fluid from said container means; and wherein said container means has a bottom wall and further has a hollow sump chamber protruding downwardly below said bottom wall and located near the backside of said container means.

15. A fluid dispensing device suitable for attachment to a paper roll dispenser comprising:

fluid container means;

suspending means attached to said fluid container means to suspend said fluid container means from the paper roll dispenser, wherein said suspending means includes a first arm and a second arm, said first arm having a first upper end, said second arm having a second upper end, wherein said first upper end is spaced a distance from said second upper end, said distance being greater than the width of the paper roll to be dispensed by the paper roll dispenser to allow said first arm and said second arm to hang on each side of the paper roll, wherein said first upper end and said second upper end each have a rearwardly elongated arm member having a rearward reach greater than one inch and defining a forward spindle stop and a rearward spindle stop thereunder for engaging paper roll dispensers in at least two distinct suspended positions;

fluid dispenser means arranged to pump fluid from said container means; and wherein said first arm and said second arm are hingedly secured to said fluid container outer shell and are collapsible thereon for storage.

16. A fluid dispensing device suitable for attachement to a paper roll dispenser comprising:

fluid container means;

suspending means attached to said fluid container means which suspends said fluid container means from the paper roll dispenser, wherein said suspending means includes a first arm and a second arm, said first arm having a first upper end, said second arm having a second upper end, wherein said first upper end is spaced a distance from said second upper end, said distance greater than the width of the paper roll to be dispensed by the paper roll dispenser to allow said first arm and said second arm to hang on each side of the paper roll, wherein said first upper end has a spacer ear attached thereto which wedges said upper end between the roll of paper being dispensed and the roll dispenser to resist lateral movement of the fluid dispensing device; and fluid dispenser means arranged to pump fluid from said container means.

17. The device of claim 16 wherein said container means has a bottom wall and further has a hollow sump chamber protruding downwardly below said bottom wall and located near the backside of said container means.

18. The device of claim 17 wherein said first upper end and said second upper end each include rearwardly facing hooks and wherein said reach of said hooks is about one and three-quarters of an inch.

19. A fluid dispensing device suitable for attachment to a paper roll dispenser comprising:

fluid container means having a backside, and a bottom wall;

suspending means attached to said fluid container means which suspends said fluid container means from the paper roll dispenser, wherein said suspending means includes a first arm and a second arm, said first arm having a first upper end, said second arm having a second upper end, wherein said first upper end is spaced a distance from said second upper end, said distance greater than the width of the paper roll to be dispensed by the paper roll dispenser to allow said first arm and said second arm to hang on each side of the paper roll, wherein a hollow sump chamber protrudes downwardly below said bottom wall and is located near said backside of said container means; and fluid dispenser means arranged to pump fluid from said container means and having a pump tube in said sump chamber.

20. Apparatus for dispensing a fluid and toilet paper to an operator comprising:

a building wall structure;

a paper roll dispenser having a wall mount, a back side adjacent to said building wall structure, and a front side opposite of said back side, said wall mount mounted to said building wall structure along said back side, said paper roll dispenser further having first and second cantilevered arms spaced apart a width greater than the width of a standard toilet paper roll, said cantilevered arms each having a recess disposed therein;

a toilet paper spindle mounted between said cantilevered arms, said spindle having a pair of ends, a central axis and a pair of outwardly extending posts at opposite ends of said spindle and concentric with said central axis, said posts engagingly mounted in said recesses;

a fluid container supported by said wall mount and having a containment chamber containing liquid skin lotion, an opening, and at least one containment wall;

a fluid pump mounted in said opening, said fluid pump having a manually reciprocally operable pump head and a pump axis, said pump head reciprocally movable along said pump axis by the operator from said front side, said pump axis projecting in an outward direction from the building wall structure allowing the operator's movement of said pump head to be forceably resisted by said building wall structure, said wall mount being mounted to said building wall structure and said pump axis being oriented in an upward angle when said wall mount is mounted to said building wall structure.

21. The apparatus of claim 20 and further comprising:

suspending means, said suspending means connected to said fluid container and suspending said fluid container below said spindle with the center of gravity of said fluid container being farther from said wall mount than said spindle axis.

22. The device of claim 21 wherein said first arm is spaced a distance from said second arm, said distance being slightly greater than the width of a standard toilet paper roll.

23. The device of claim 20 wherein said fluid container is rigidly connected to said wall mount.

24. Apparatus for dispensing a fluid and toilet paper to an operator comprising:

a building wall structure;

a paper roll dispenser having a wall mount, a back side adjacent to said building wall structure, and a front side opposite of said back side, said wall mount mounted to said building wall structure along said back side, said paper roll dispenser further having a pair of cantilevered arms spaced apart a width greater than the width of a standard toilet paper roll, said cantilevered arms each having a recess disposed therein;

a toilet paper spindle mounted between said cantilevered arms, said spindle having a pair of ends, a central axis and a pair of outwardly extending posts at opposite ends of said spindle and concentric with said central axis, said posts engagably mounted in said recesses;

a fluid container supported by said wall mount and having a containment chamber, an opening, and at least one containment wall;

a fluid pump mounted in said opening, said fluid pump having a manually reciprocally operable pump head and a pump axis, said pump head reciprocally movable along said pump axis by the operator from said front side, said pump axis projecting in an outward direction from the building wall structure allowing the operator's movement of said pump head to be foreceably resisted by said building wall structure;

wherein said wall mount is mountable to a building wall structure and wherein said pump axis is oriented in an upward angle when said wall mount is positioned to be mounted to a building wall structure;

wherein said fluid container is rigidly connected to said wall mount; and wherein at least one of said cantilevered arms is hollow and is said fluid container.

25. Apparatus for dispensing fluid and toilet paper to an operator and comprising:

a vertical wall;

a toilet paper roll dispenser mounted on the wall and having roll support means thereon;

fluid container means for containing a fluid to be dispensed;

first and second hanger arms having upper ends mounted on the roll support means and having lower ends holding the fluid container means whereby the fluid container means is hung from the roll support means and at the front of the wall but is readily removable by lifting off the roll support means to facilitate replacement of a paper roll on the roll support means; and a fluid dispenser head on the container means and operable by manual force and movement relative to the container means in a direction at a downward angle toward the wall to dispense fluid from the container means.

26. The apparatus of claim 25 and wherein:

the roll support means comprise a spindle having an elongate axis generally parallel to the wall where the dispenser is mounted; and the upper ends of the arms are downwardly opening hooks that are hooked and hung on the spindle at opposite sides of a toilet paper roll mounted on the spindle.

27. The apparatus of claim 26 and wherein:

the dispenser head is located farther from the wall than is the spindle axis.

28. The apparatus of claim 26 and wherein:

the combination of the fluid container means and arms and head have a center of gravity that is farther from the wall than is the spindle axis.

* * * * *